US010265954B2

(12) United States Patent
Furuta

(10) Patent No.: US 10,265,954 B2
(45) Date of Patent: Apr. 23, 2019

(54) IMAGE PROCESSING APPARATUS AND IMAGE PROCESSING METHOD

(71) Applicant: SEIKO EPSON CORPORATION, Tokyo (JP)

(72) Inventor: Tatsuo Furuta, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/805,552

(22) Filed: Nov. 7, 2017

(65) Prior Publication Data

US 2018/0134036 A1 May 17, 2018

(30) Foreign Application Priority Data

Nov. 16, 2016 (JP) ..... 2016-222950

(51) Int. Cl.
*B41J 19/14* (2006.01)
*B41J 2/045* (2006.01)
*B41J 2/21* (2006.01)

(52) U.S. Cl.
CPC ..... *B41J 2/04593* (2013.01); *B41J 2/04586* (2013.01); *B41J 2/2128* (2013.01); *B41J 19/145* (2013.01)

(58) Field of Classification Search
CPC .... B41J 2/04593; B41J 2/2128; B41J 19/145; B41J 2/04586
See application file for complete search history.

(56) References Cited

U.S. PATENT DOCUMENTS

| | | | | |
|---|---|---|---|---|
| 9,415,586 | B1 * | 8/2016 | Hayashi | B41J 2/2132 |
| 2013/0100204 | A1 * | 4/2013 | Norasak | B41J 29/377 347/37 |
| 2016/0243827 | A1 * | 8/2016 | Hawkins | B41J 2/1433 |

FOREIGN PATENT DOCUMENTS

| | | | |
|---|---|---|---|
| JP | 2010-179626 | A | 8/2010 |
| JP | 5273919 | B2 | 8/2013 |
| JP | 2014-172349 | A | 9/2014 |
| JP | 2016-172357 | A | 9/2016 |

* cited by examiner

*Primary Examiner* — Henok D Legesse

(57) ABSTRACT

After dot image data is created via a halftone process, dot size determination is performed in step S110, it is determined there is a smaller dot in front motion in step S112, and, when the smaller dot is to be allocated to a front nozzle line, a moving process is performed thereon in step S116. Once moved by one dot, the dot position of a smaller dot is allocated to a rear nozzle line and thus discharged from the rear nozzle line that is less affected by an air flow.

10 Claims, 10 Drawing Sheets

NOT AFFECTED BY WIND

AFFECTED BY WIND

IMAGE PROCESSING APPARATUS AND IMAGE PROCESSING METHOD

BACKGROUND

1. Technical Field

The present invention relates to an image processing apparatus and an image processing method, in particular, to an image processing apparatus and an image processing method adapted to generate, from image data, print data used for a printing apparatus that discharges droplets such as ink droplets for printing.

2. Related Art

In an ink jet printer, air present on the front side in a primary scan direction flows backward relative to a carriage due to motion of the carriage. The air flowing through a paper gap causes dots to be spread in a secondary scan direction before impact, and the degree of such spread dots is greater for a line closer to the front side in the primary scan direction.

In the related art disclosed in JP-A-2010-179626, mobile members (a belt and rollers) are provided to generate an air flow flowing forward in a moving direction of a carriage. This prevents an air flow from inflowing between a discharge outlet and a recording medium regardless of the speed at which the carriage is moving. This may allow for a reduction of wind ripple.

SUMMARY

According to the related art described above, it is necessary to provide a printing apparatus with additional mobile members such as a belt and rollers. This leads to a problem of a complex structure of the printing apparatus or a problem of increased manufacturing costs of the printing apparatus, and thus there is room for improvement of wind ripple. The invention provides an image processing apparatus an image processing method that reduces wind ripple.

According to an aspect of the invention, an image processing apparatus generating, from image data, print data used for a printing apparatus that comprises a head which is movable in a primary scan direction relative to a medium and in which a plurality of nozzles adapted to discharge the same color ink to form dots are provided and forms dots of different sizes. The image processing apparatus further comprises a halftone processing unit that generates dot data and a print data generating unit that generates the print data based on the dot data and is configured such that, when dot data including a dot size and a dot position of a first dot and a second dot that is larger than the first dot, the dot data of the first dot and the dot data of second dot are corrected in accordance with a front nozzle line or a rear nozzle line in the primary scan direction to which the first dot and the second dot correspond.

In the configuration described above, when generating dot data including a dot size and a dot position of a first dot and a second dot that is larger than the first dot, the halftone processing unit and the print data generating unit determine to which of the front nozzle line or the rear nozzle line in the primary scan direction the first dot and the second dot correspond and correct the dot data of the first dot and the second dot in accordance with the determination result.

As an example, the first dot is called the smaller dot, the larger second dot is called the larger dot, and it is possible to correct the first dot so as to move in accordance with the rear nozzle line when the first dot is located in the front nozzle line and to correct the second dot so as to move in accordance with the front nozzle line when the second dot is located in the rear nozzle line.

The halftone processing unit may generate, from the image data, dot data including a dot size and a dot position of the first dot and the second dot that is larger than the first dot, and the print data generating unit may correct the dot data of the first dot and the second dot to generate correction data in accordance with which of a front nozzle line or a rear nozzle line in the primary scan direction the first dot and the second dot correspond to and generate the print data based on the correction data.

A process of generating, from the image data, dot data including a dot size and a dot position of a first dot and a second dot that is larger than the first dot is a normal halftone process. In the above configuration, the halftone processing unit performs the normal halftone process. The print data generating unit corrects dot data of the first dot and the second dot in accordance with which of the front nozzle line and the rear nozzle line in the primary scan direction the first dot or the second dot correspond to and generates correction data based on the correction data.

According to another aspect of the invention, when generating, from the image data, dot data including a dot size and a dot position of the first dot and the second dot that is larger than the first dot, the halftone processing unit may correct the dot data of the first dot and the second dot and generate dot data in accordance with which of a front nozzle line or a rear nozzle line in the primary scan direction the first dot and the second dot correspond to.

In the above configuration, the halftone processing unit corrects dot data of the first dot and the second dot in accordance with which of the front nozzle line and the rear nozzle line in the primary scan direction the first dot or the second dot correspond to and generates correction data in addition to the normal halftone process.

According to the image processing apparatus and the image processing method of the invention, wind ripple can be reduced.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Embodiments of the invention will be described below with reference to the drawings.

Figure 1:
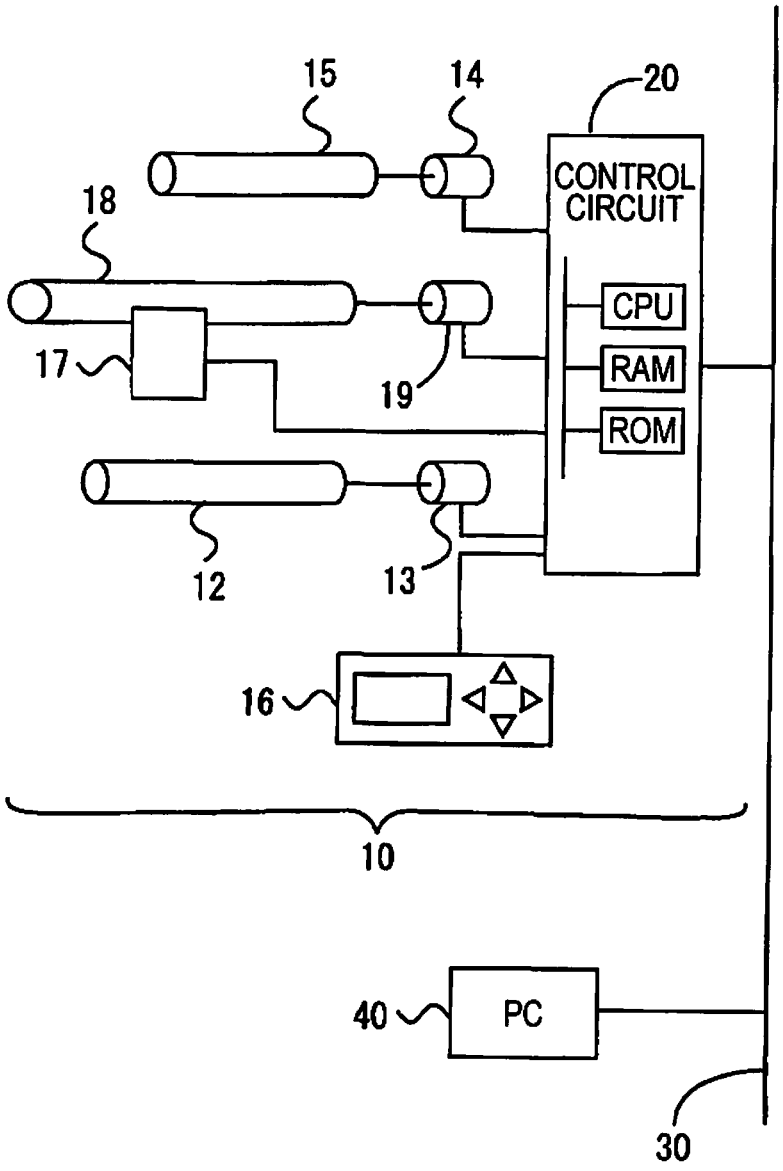
FIG. 1 is a block diagram of a printing system to which the invention is applied.

FIG. 1 is a block diagram of a printing apparatus to which the invention is applied.

In FIG. 1, a print head 17 of a printer 10 (a printing apparatus) discharges, from nozzles, four or six colors of ink supplied from ink tanks. The print head 17 in which nozzles are oriented in a sheet feed direction is driven and reciprocated in a predetermined range by a belt 19 driven by a carriage motor 18. Such a type of printer in which the print head 17 is reciprocated in accordance with transport of a sheet is called a serial printer in this disclosure, although there are various names for such a printer.

A platen 12 is driven and rotated by a platen motor 13 and thereby the print head 17 is transported with a sheet intersecting the print head 17. Nozzles are aligned in a sheet transport direction in the print head 17 and move relative to and above a sheet in accordance with transport of the sheet and reciprocation of the print head 17 in the width direction of the sheet. A direction in which the print head 17 reciprocates in the width direction of a sheet is called a primary scan direction, and a direction in which the print head 17 moves in the sheet length direction relative to and above the fed sheet is called a secondary scan direction.

A feed motor 14 drives a sheet feed roller 15 that supplies a sheet accommodated in a predetermined sheet stacker.

Note that such a type of printer that a print head is disposed across the width direction of a sheet and moves relative to the transport of the sheet is called a line printer.

A control circuit 20 is configured in combination with a dedicated IC and includes or functions as a CPU, a ROM, and a RAM. The control circuit 20 controls driving of the print head 17, the carriage motor 18, the platen motor 13, and the feed motor 14. The control circuit 20 is equipped with an operation panel and display unit 16 and causes the operation panel and display unit 16 to accept a particular operation input by a user and output a predetermined display. The above hardware components are collectively called a printing mechanism.

The control circuit 20 outputs drive signals for causing the print head 17 to discharge ink droplets, specifically, to discharge a plurality of ink droplets of different sizes such as smaller dots, medium dots, and larger dots. Several schemes of discharging such multi-sized dots have been realized, and may include, for example, a scheme of discharging two smaller dots or two medium dots to form a larger dot. On the other hand, a smaller dot, a medium dot, or a larger dot is selected in accordance with print data indicating an ink amount.

The printer 10 of the present embodiment is connected to a network 30 and, once acquiring print data from a PC 40 or the like via the network 30, performs printing corresponding to the print data.

Figure 2:
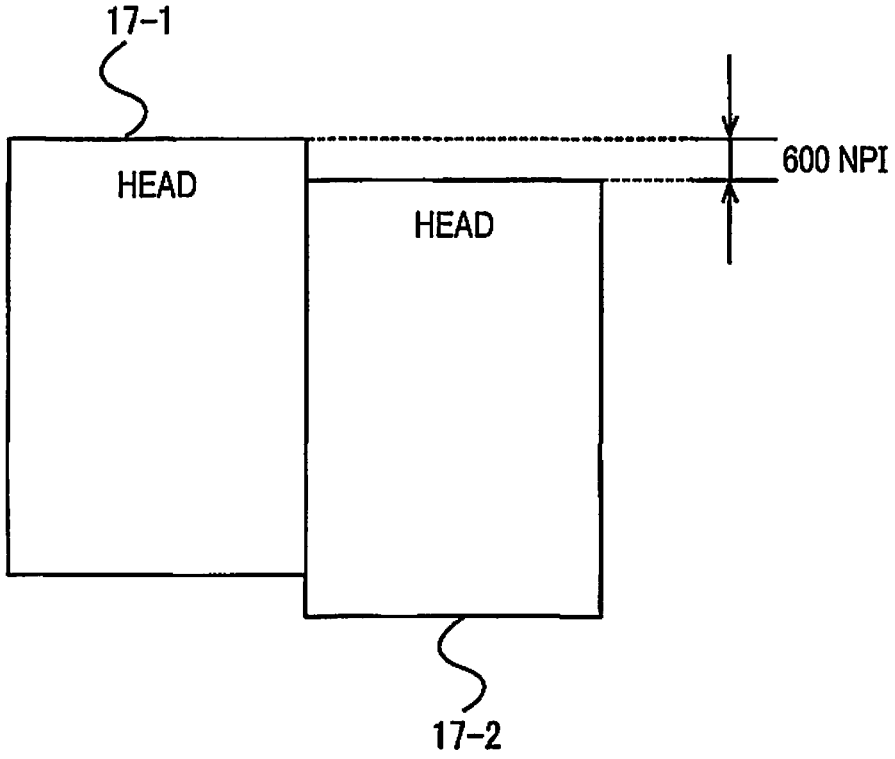
FIG. 2 illustrates the structure of a print head.

FIG. 2 illustrates the structure of the print head 17.

The print head 17 of the present embodiment is formed of a first head 17-1 and a second head 17-2. The first head 17-1 and the second head 17-2 each have a nozzle density of 300 NPI and are connected so as to overlap each other in the primary scan direction. In this state, the first head 17-1 and the second head 17-2 are shifted from each other by half the nozzle pitch in the secondary scan direction. Since the nozzles of one of the heads are located between the nozzles of the other head, the two heads 17-1 and 17-2 enable the print head 17 to have a nozzle pitch of 600 NPI that is twice the resolution of the nozzle pitch of 300 NPI in the case of a single head.

Figure 3:
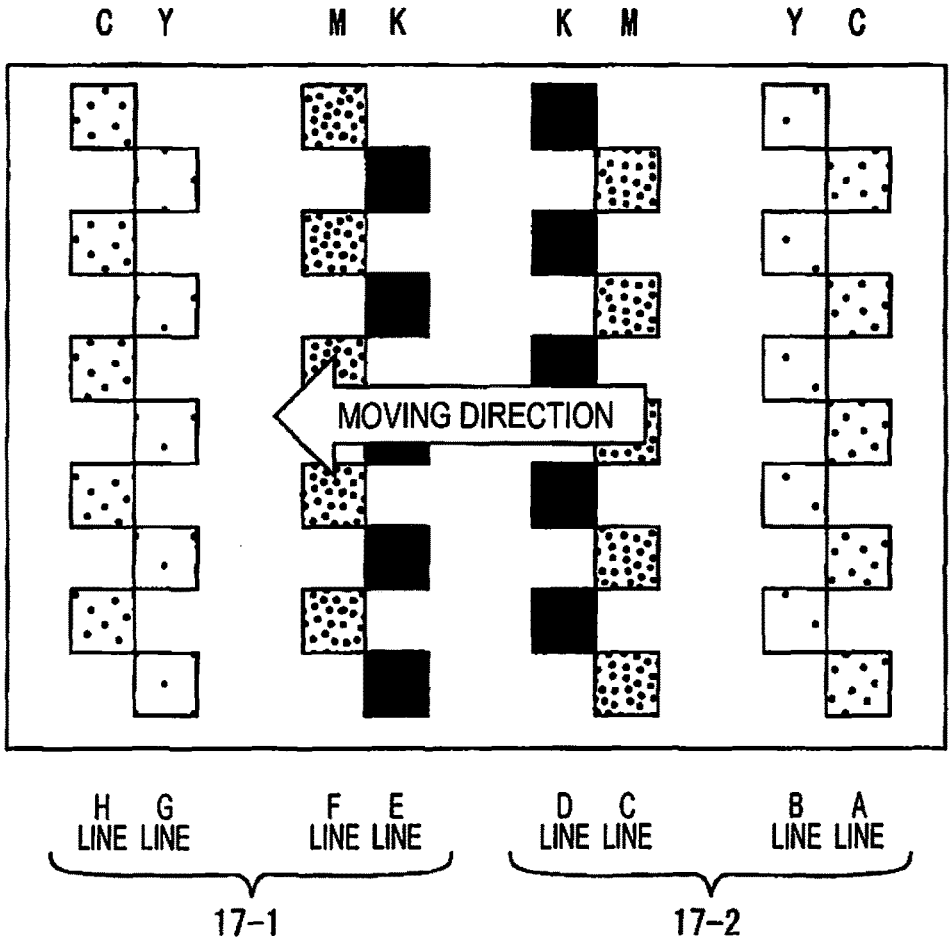
FIG. 3 illustrates an arrangement of nozzles and ink colors in the print head.

FIG. 3 illustrates an arrangement of the nozzles and ink colors in the print head 17.

As illustrated in FIG. 3, each of the heads 17-1 and 17-2 has nozzle lines to which four colors of cyan, yellow, magenta, and black are supplied. Line A, line B, line C, line D, line E, line F, line G, and line H are disposed in this order from the right. Further, the order of the ink colors from the line A is cyan, yellow, magenta, black, black, magenta, yellow, and cyan. That is, the order of the ink colors is inverted with respect to the boundary at the connection portion of the heads 17-1 and 17-2. Thus, the nozzles which discharge cyan have the largest interval, and the nozzles which discharge black have the smallest interval.

Figure 4:
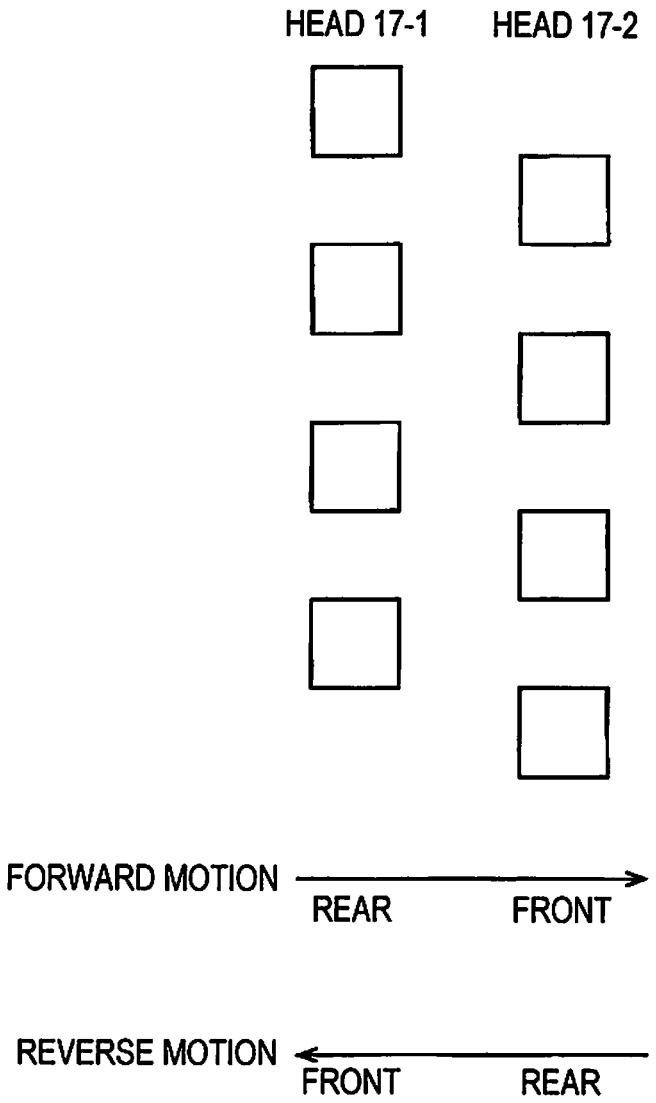
FIG. 4 is a diagram illustrating a relationship of a front nozzle line and a rear nozzle line in a forward motion and a reverse motion.

FIG. 4 is a diagram illustrating the relationship of a front nozzle line and a rear nozzle line in a forward motion and a reverse motion.

As described above, the same set of ink colors is allocated to the heads 17-1 and 17-2, and the offset of the heads 17-1 and 17-2 by the nozzle pitch of 600 NPI enables the heads 17-1 and 17-2 each having a nozzle pitch resolution of 300 NPI to realize a nozzle pitch resolution of 600 NPI. In this case, the heads 17-1 and 17-2 form a pair of nozzle lines for the same ink color, and ink of a specific color is discharged first from one of the nozzle lines and next from the other nozzle line in the moving direction of the print head 17. The nozzle line that discharges the ink first is called the front nozzle line, and the next nozzle line that discharges the ink next is called the rear nozzle line.

Configuration of the print head 17 in such a manner enables the print head 17 to move in the primary scan direction relative to a medium, which means that a plurality of nozzles for discharging ink of the same color to form dots are provided in the primary scan direction.

With reference to FIG. 4, there are two nozzle lines whose nozzle positions are arranged in a staggered manner, and the print head 17 moves in the forward motion direction and the reverse motion direction indicated under the nozzle lines. In this case, in the forward motion, the nozzle line of the head 17-2 is the front nozzle, and the nozzle line of the head 17-1 is the rear nozzle. Conversely, in the reverse motion, the nozzle line of the head 17-1 is the front nozzle, and the nozzle line of the head 17-2 is the rear nozzle.

The nozzle lines of the heads 17-1 and 17-2 are located such that each of the nozzles of one of the heads is located in gaps between the nozzles of the other head. For example, with respect to dot lines of print pixels, an alignment extending in the primary scan direction is called a row, and the head 17-1 performs printing using odd numbered rows and the head 17-2 performs printing using even numbered rows. Therefore, movement of a dot up or down by one dot to a neighboring pixel position with respect to a particular pixel corresponds to movement from the front nozzle to the rear nozzle or from the rear nozzle to the front nozzle.

This means that, by performing correction of moving one dot up or down by one dot to a neighboring pixel position with respect to a particular pixel, a nozzle line which discharges the dot is corrected from the front nozzle to the rear nozzle or from the rear nozzle to the front nozzle.

Figure 5:
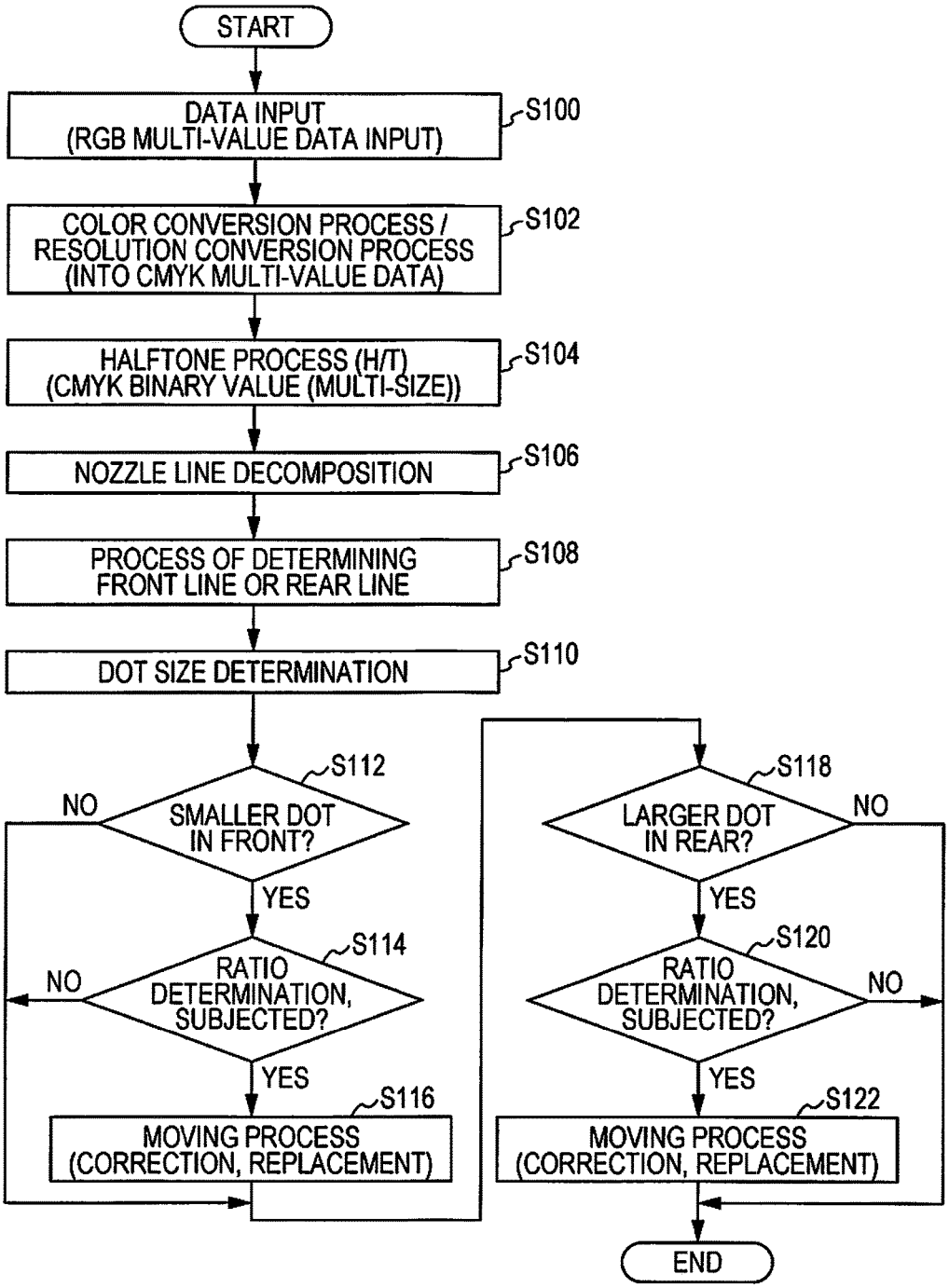
FIG. 5 is a flowchart of a control program applicable to the invention.

FIG. 5 is a flowchart of a control program applicable to the invention.

Once an application running on the PC 40 performs a printing process as a process of generating print data for printing by the printer 10, a printer driver is initialized by the PC 40, and the printer driver may process the print data, or the printer 10 may receive the data in an intermediate format via the network 30 and process the print data.

First, an example process performed by the printer driver of the PC 40 will be described.

In the printer driver process, in step S100, data input is performed. Typically, the application started on the PC 40 outputs RGB multi-value data as print data that is input in step S100. The RGB multi-value data is data in which each pixel is represented by red (R), green (G), and blue (B) values each in the range of 256 distinct values. Note that this is a mere example, and a greater number of values per color may be employed.

In step S102, a color conversion process is performed. Accurate color conversion is important in a printing process, and the RGB multi-value data is converted into CMYK multi-value data. The CMYK multi-value data is data in which each pixel is represented by C (cyan), M (magenta), Y (yellow), and K (black) values each in the range of 256 distinct values. Note that, in addition to the above, conversion of the resolution is performed in accordance with the resolution of the printer. In general, the dot density of the printer 10 is often larger than the resolution of the application.

Next, in step S104, a halftone process (H/T) is performed. The halftone process is to convert multi-value data into binary data and, in addition, when the printer 10 supports a plurality of dot sizes, generate binary dot data for each color and each dot size. This dot data includes information of dot size and dot position. Since a plurality of dot sizes are supported, dots may include a first dot, which is a smaller dot, and a second dot, which is larger than the first dot. Thus, the dot data includes information on the first dot and the second dot. Step S104 is associated with the halftone processing unit.

Note that, without being limited to the case of two particular dot sizes, the first dot and the second dot may be applied to a case of small, medium, and large dots, the first dot may be the medium dot, and the second dot may the large dot.

In the above process, the dot data corresponds to the nozzle density, and each nozzle corresponds to an ink droplet. Therefore, when the print head 17 is reciprocated for printing, a process of dividing dot data for respective paths of the print heads may be performed. This process is known as raster decomposition. Note that, for a particular number of nozzles on the upstream side and on the downstream side of the nozzle line, and when two paths are used for overprinting, dot data needs to be divided into data on a per-path basis, and raster decomposition is required.

Next, in step S106, a nozzle line decomposition process is performed. As described above, when the heads 17-1 and 17-2 are used, printing is performed separately by each of the two nozzle lines. Since the nozzle lines are located in different positions in the primary scan direction, it is necessary to perform discharging at different timings for dots corresponding to the front nozzle line and dots corresponding to the rear nozzle line with respect to the neighboring dots in the secondary scan direction in a dot image. This is addressed by the nozzle line decomposition process.

As discussed above, the dot position corresponds to the nozzle line for each size. In the next step S108, a process of determining a front line or a rear line is performed. Further, whether the moving direction of the print head 17 corresponds to the forward motion or the reverse motion as illustrated in FIG. 4 is determined.

In step S110, dot size determination is performed. In step S112, whether the dot in the front line is smaller is determined. Since dot data is prepared for each size, the dot size determination process is included in a process of selecting dot data to be used. Determination is potentially made and thus no particular determination is necessary.

Figure 6:
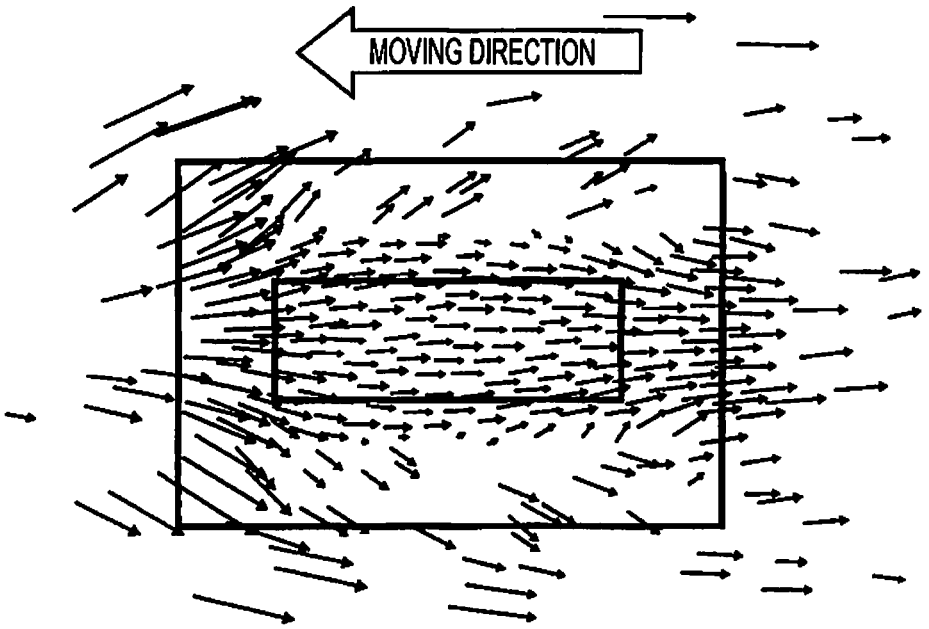
FIG. 6 illustrates an analysis result of air flow due to motion of the print head.

FIG. 6 illustrates an analysis result of air flow due to motion of the print head 17.

Since movement of the print head 17 displaces surrounding air, an air flow occurs in the paper gap. FIG. 6 illustrates an air flow when the print head 17 moves to the left with respect to figure, and large turbulence of the air flow occurs in the left (on the side of the front nozzle). Since the print head 17 moves against a stationary air, it is found that the air moves away from the print head 17 in the vertical direction. Since a paper gap is interposed between a sheet and the print head, the air in front moves away only in the vertical direction. The air in the middle portion in the secondary scan direction moves away to the upstream side in the secondary scan direction and moves away to the downstream side in the secondary scan direction. That is, an air flow occurs in the upstream and downstream directions.

In contrast, on the right side (on the side of the rear nozzle), a stable air flow occurs substantially parallel to the primary scan direction and has less influence on the air flow.

The effect of this air flow is highest for droplets of low mass. In other words, a larger dot is less likely to be affected, and a smaller is more likely to be affected.

Figure 7:
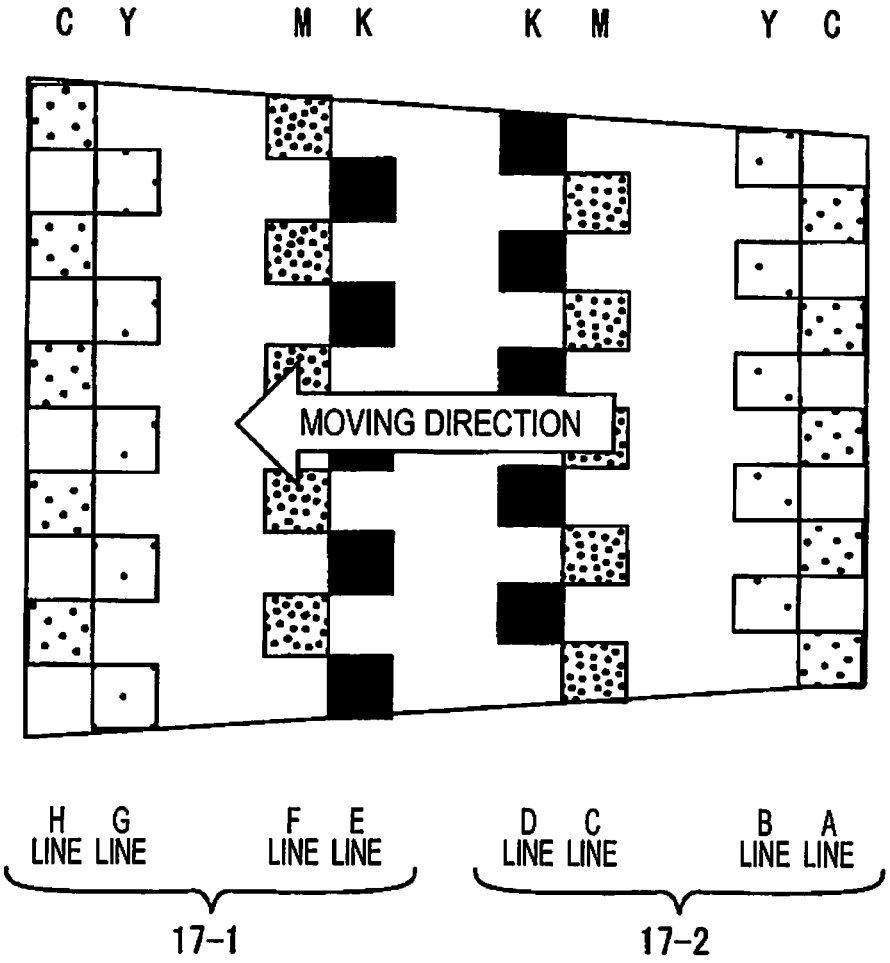
FIG. 7 illustrates deformation of an image due to attachment of ink droplets affected by air flow.

FIG. 7 illustrates deformation of an image due to attachment of ink droplets affected by an air flow.

A phenomenon in which smaller dots are spread in the vertical direction due to an air flow and impact a sheet appears significantly in the case of smaller dots that are more likely to be affected by the air flow. Such a phenomenon is significant on the front nozzle side, while, on the rear nozzle side, the dots mostly impact the expected positions. It appears as if the nozzle positions arranged in a matrix orthogonal to the vertical direction and the horizontal direction as illustrated in FIG. 3 were changed to a distorted nozzle arrangement distorted in the form of a trapezoid as illustrated in FIG. 7 due to the influence of the air flow.

Figure 8A:
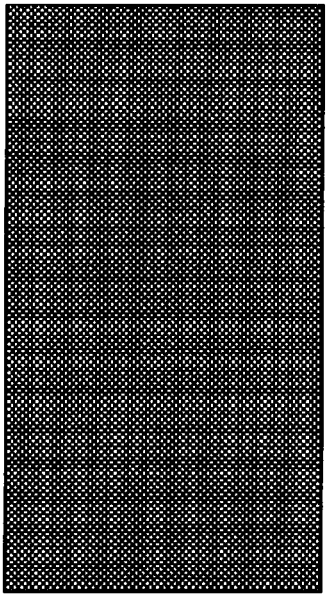
FIG. 8A and FIG. 8B schematically illustrate print results when ink droplets are discharged.
Figure 8B:
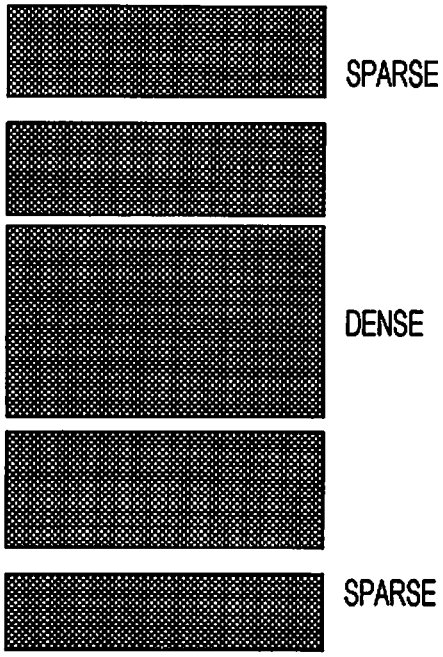

FIG. 8A and FIG. 8B schematically illustrate print results when ink droplets are discharged.

Since impact occurs at a position displaced from an expected position in the vertical direction, the square printed image with the same concentration as illustrated in FIG. 8A is changed such that the upper end side and the lower end side are sparser than the middle portion in the secondary scan direction as illustrated in FIG. 8B. This is because impact positions are spread vertically, which results in a low concentration.

As an approach to suppress such an influence of an air flow, the invention performs correction such that relatively smaller dots which would otherwise be discharged from the front nozzle line are discharged from the rear nozzle line.

When the above correction is performed on all the dots, however, the appearance of an original dot image may be significantly different from the appearance of a dot image determined through a precise process, and thus correcting is performed on dots included in a range of a preset ratio. In step S114, ratio determination is made to determine whether or not the dot is subjected to a subsequent process. For example, when smaller dots in a dot image are discharged from the front nozzle line and up to 60% of the dot image is set to be subjected to correction, it is determined whether or not a generated random number is 60% or less when it is determined that the smaller dot is discharged from the front nozzle line. If the generated random number is 60% or less, the smaller dot is subjected to a moving process (correction, exchange) in step S116. As described above, in a dot image, upward or downward motion by one pixel may cause a smaller dot that would otherwise be discharged from the front nozzle line to be discharged from the rear nozzle line, or may cause a smaller dot that would otherwise be discharged from the rear nozzle line to be discharged from the front nozzle line.

With two-path printing being employed instead of single-path printing, it is possible to perform discharging from the rear line instead of the front line while performing discharging from the same nozzle. However, the required printing time will be doubled for two-path printing.

Next, in step S118, whether the dot in the rear line is larger is determined. Since a larger dot is less likely to be affected by an air flow, a larger dot which would otherwise be discharged from the rear nozzle line is discharged from the front nozzle line. In the same manner as in the case of a smaller dot, in step S120, ratio determination is performed to determine whether or not the dot is to be subjected to a subsequent process based on a preset ratio. This ratio may be the same as or different from that for a smaller dot. If the ratio determination determines that correction should be performed in the same manner as in the determination for a smaller dot, a moving process (correction, exchange) is performed in step S122. That is, correction is made so that a larger dot of the rear nozzle line is moved to an upper or lower pixel position and thereby discharged from the front nozzle line.

As discussed above, a smaller dot of the front nozzle is corrected to be discharged from the rear nozzle and a larger dot of the rear nozzle is corrected to be discharged from to the front nozzle via the process of steps S112 to S118. Such process is associated with a print data generating unit that corrects data of the first dot and the second dot to generate correction data in accordance with which of the front nozzle line and the rear nozzle line in the primary scan direction the first dot and the second dot correspond to and generates the print data based on the correction data.

Figure 9:
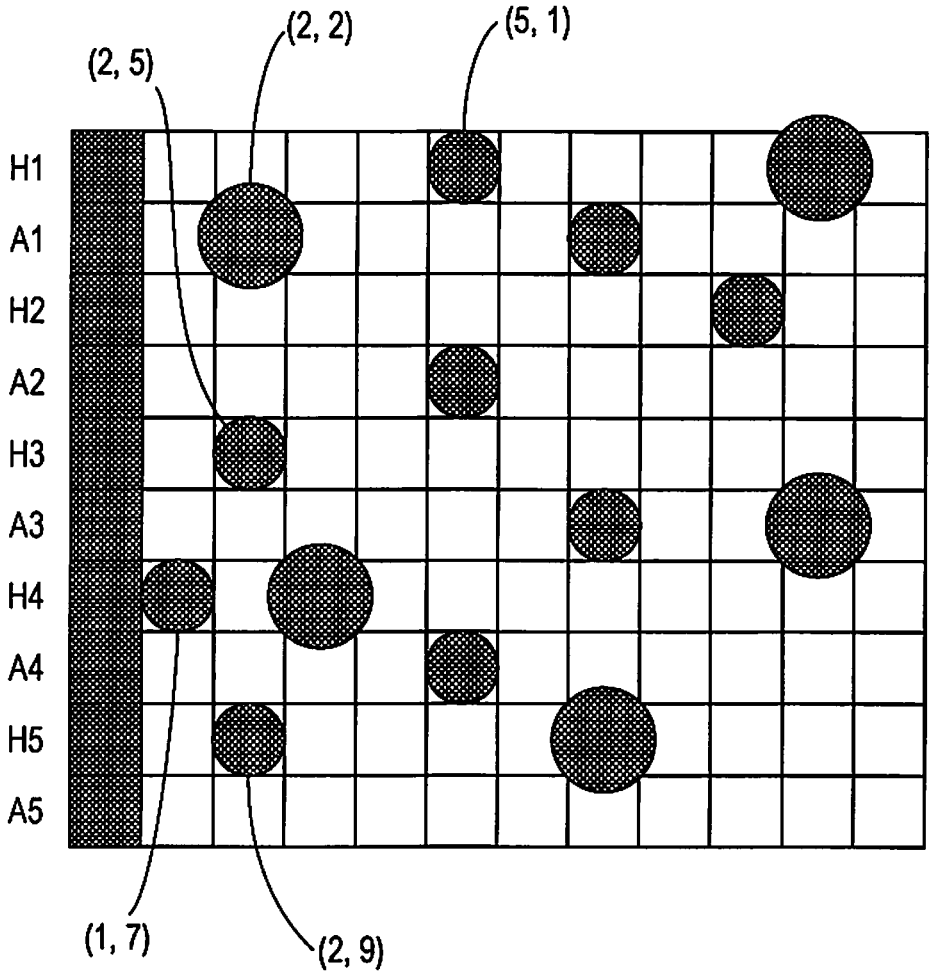
FIG. 9 schematically illustrates dot data after a halftone process before correction.
Figure 10:
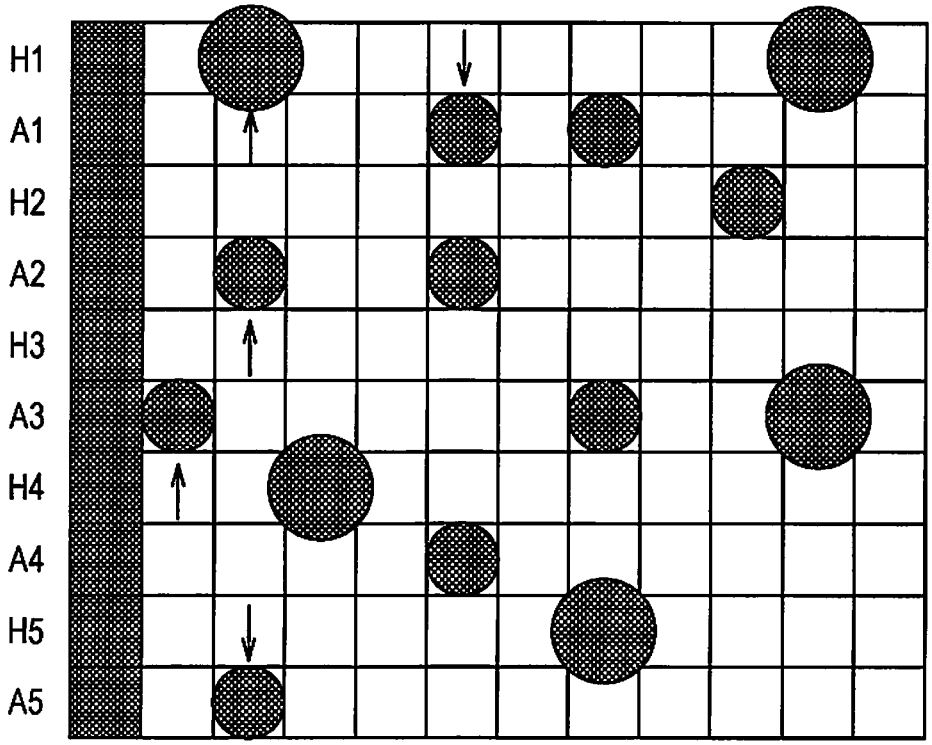
FIG. 10 schematically illustrates a view of a correction process.

FIG. 9 schematically illustrates dot data after a halftone process before correction. Further, FIG. 10 schematically illustrates a view of the correction process.

FIG. 9 illustrates nozzle lines and nozzle numbers in the left side. The top H1 denotes the first nozzle from the top on a nozzle line H. In a similar manner, A1 denotes the first nozzle on a nozzle line A, H2 denotes the second nozzle on the nozzle line H, . . . , and so on. Each of the squares illustrated in the right side indicates the position of each pixel (dot position). For simplified illustration, a position is denoted as coordinates (x, y), the leftmost, uppermost square is defined as an origin (1, 1), and each value of coordinates is incremented by one in the right direction corresponding to x coordinate and incremented by one in the downward direction corresponding to y coordinate.

Each larger circle protruding over a square is a larger dot, and each smaller circle included in a squire is a smaller dot. In such a way, dot size information is represented.

Based on this dot data, when the print head 17 moves to the left as illustrated in FIG. 3, the nozzle line H is the front nozzle line and the nozzle line A is the rear nozzle line. When focusing on the nozzle H1 included in the front nozzle line, a smaller dot is attached at a dot position (5, 1). When the ratio determination is neglected for simplified illustration, since this is a state of a smaller dot being allocated to the front nozzle line, the smaller dot is subjected to a moving process in step S116 via the determination of step S112. As illustrated in FIG. 10, after moved to the dot position (5, 2), the smaller dot is allocated to the nozzle line A and thus is discharged from the rear nozzle line which is less affected by an air flow.

A smaller dot at (2, 5) of the nozzle H3, a smaller dot at (1, 7) of the nozzle H4, and a smaller dot at (2, 9) of the nozzle H5 are subjected to the same determination and, when moved to the dot positions (2, 4), (1, 6), and (2, 10), will be discharged from the rear nozzle line A.

Further, with reference to FIG. 9 for larger dots, a larger dot is to be allocated to the dot position (2, 2). This dot position corresponds to discharging from the nozzle A2 and thus corresponds to discharging from the rear nozzle line. Therefore, the dot is subjected to a moving process in step S122 via the determination of step S118 when the ratio determination is neglected. Specifically, motion from the dot position (2, 2) to the dot position (2, 1) leads to discharging from the nozzle H1 and thus discharging from the front nozzle line.

Such corrected dot data is typically used for control of drive signals for driving respective nozzles of the print head 17 based on the data. The control process of these drive signals corresponds to the final print data generation process. When the PC 40 performs the process, the PC 40 that implements a predetermined program to perform the process corresponds to the halftone generating unit and the print data generating unit and also corresponds to the image processing apparatus including these units. It is possible that the PC 40 performs the process up to generation of corrected dot data and the printer 10 receives the corrected data and generates drive signals.

In the above description, the printer driver of the PC 40 generates print data. On the other hand, the printer 10 may receive an intermediate print language via the network 30 and process the print data. In this case, the control circuit 20 in the printer 10 can be responsible for the process described above.

The control circuit 20 in the printer corresponds to the halftone generating unit and the print data generating unit in the same manner as the case of the PC 40 described above and also corresponds to the image processing apparatus including these units. Further, the program that causes the PC 40 and the control circuit 20 to perform the process described above corresponds to an image processing program, and corresponds to a ROM, a hard disk, or the like that stores the program therein corresponds to a medium that stores the image processing program therein. Other medium may be employed for implementation.

Second Embodiment

In the first embodiment, dot data which is less likely to be affected by an air flow is obtained by correcting dot data generated in the halftone process.

On the other hand, it is possible to realize such correction in the halftone process. That is, when dot data of CMYK binary data including the dot size and the dot position of the first dot and the second dot that is larger than the first dot is generated from image data of RGB multi-value data, dot data of the first dot and dot data of the second dot are corrected to generate dot data in accordance with which of the front nozzle line or the rear nozzle line in the primary scan direction the first dot and the second dot correspond to.

In the same manner as the example described above, a smaller dot is generated at a position corresponding to discharging from the rear nozzle line in the halftone process so that dot data which causes a smaller dot to be discharged from the front nozzle line is not resulted.

For example, some recording method can determine in advance relative motion of the print head 17 and a sheet, and thus each dot position may already correspond to each nozzle of the print head 17 before generating dot data. Therefore, for each dot position, the print head 17 can determine which of the forward motion or the reverse motion of what number of paths a printing operation is performed in and which of the forward nozzle line or the rear nozzle line is used at the printing operation.

A dither mask may be designed by referring to a "nozzle map". For example, a dither map such as "a smaller dot is generated first from a position where the rear line nozzle in the forward motion is used, and a larger dot is generated first from a position where the front line nozzle in the forward motion" may be created.

With the halftone process using such a dither mask, dot data implementing the content described above may be generated by one time of application of a dither mask without an individual correction process being performed.

Third Embodiment

As illustrated in FIG. 3, the interval between the nozzle line H and the nozzle line A that discharge cyan color ink is relatively larger, and the interval between the nozzle line E and the nozzle line D that discharge black color ink is relatively smaller. Further, as illustrated in FIG. 7, the difference between the nozzle line H and the nozzle line A that discharge cyan color ink due to the vertical spread of ink droplets is relatively larger, and the difference between the nozzle line E and the nozzle line D that discharge black color ink due to the vertical spread of ink droplets is relatively smaller.

This is approximately proportional to the interval between the nozzle lines, as illustrated in FIG. 7. Therefore, the processing time can be reduced by applying the above process to only the color associated with a larger interval of the nozzle lines and omitting the above process for the color associated with a smaller interval of the nozzle lines. A predetermined threshold may be set in advance and it may be determined whether or not the interval exceeds the threshold.

That is, when the interval between the front nozzle line and the rear nozzle line is different among ink colors, dot data is corrected for the ink color associated with a larger difference than a predetermined distance.

Fourth Embodiment

Since an air flow is caused by motion of the print head 17, the speed of the print head 17 also affects the air flow or accordingly wind ripple. In general, the speed of the print head 17 affects the impact position of an ink droplet, and the speed of the print head 17 is managed by the control circuit 20. Thus, the above process may be performed when the moving speed of the print head is larger. Also in this case, a predetermined threshold may be compared.

The moving speed may be sensed directly, or may be sensed indirectly based on an index value or a control signal in the step of determining the moving speed. For example, the maximum speed may not be reached when the moving range of the print head 17 is shorter, or the moving speed may be determined as a predetermined constant speed considered as a predetermined value when the motion range is longer.

In such a way, a parameter corresponding to the moving speed of the print head is detected and, when the moving speed is higher, dot data for performing discharging by the front nozzle line is corrected to dot data for performing discharging by the rear nozzle line, or dot data for performing discharging by the rear nozzle line is corrected to dot data for performing discharging by the front nozzle line.

Note that the invention is not limited to the embodiments described above. Those skilled in the art will appreciate that disclosure of the embodiment of the invention includes:

- application with a different combination of a replaceable member or feature disclosed in the above embodiments,
- application with replacement or a different combination of a known member or feature which is replaceable with the member or feature disclosed in the above embodiments, and
- application with replacement or a different combination of a member or feature which can be an alternative to the member or feature disclosed in the above embodiments expected by those skilled in the art based on the known art.

This application claims priority under 35 U.S.C. § 119 to Japanese Patent Application No. 2016-222950, filed Nov. 16, 2016. The entire disclosure of Japanese Patent Application No. 2016-222950 is hereby incorporated herein by reference.

What is claimed is:

1. An image processing apparatus generating, from image data, print data used for a printing apparatus that comprises a head which is movable in a primary scan direction relative to a medium and in which a plurality of nozzles adapted to discharge the same color ink to form dots are provided and forms dots of different sizes, the image processing apparatus further comprising a halftone processing unit that generates dot data and a print data generating unit that generates the print data based on the dot data, wherein, when dot data including a dot size and a dot position of a first dot and a second dot that is larger than the first dot, the dot data of the first dot and the second dot is corrected in accordance with which of a front nozzle line or a rear nozzle line in the primary scan direction the first dot and the second dot correspond.

2. The image processing apparatus according to claim 1, wherein the halftone processing unit generates, from the image data, dot data including a dot size and a dot position of the first dot and the second dot that is larger than the first dot, and wherein the print data generating unit corrects the dot data of the first dot and the second dot to generate print data in accordance with which of a front nozzle line or a rear nozzle line in the primary scan direction the first dot and the second dot correspond and generates the print data based on the correction data.

3. The image processing apparatus according to claim 1, wherein, when generating, from the image data, dot data including a dot size and a dot position of the first dot and the second dot that is larger than the first dot, the halftone processing unit corrects the dot data of the first dot and the second dot to generate dot data in accordance with which of a front nozzle line or a rear nozzle line in the primary scan direction the first dot and the second dot correspond.

4. The image processing apparatus according to claim 1, wherein dot data which causes the front nozzle line to discharge the first dot is corrected to dot data which causes the rear nozzle line to discharge the first dot.

5. The image processing apparatus according to claim 1, wherein dot data which causes the rear nozzle line to discharge the second dot is corrected to dot data which causes the front nozzle line to discharge the second dot.

6. The image processing apparatus according to claim 1, wherein, when dot data which causes the front nozzle line to perform discharging is corrected dot data which causes the rear nozzle line to perform discharging, or when dot data which causes the rear nozzle line to perform discharging is corrected dot data which causes the front nozzle line to perform discharging, a dot position is changed to a neighboring dot position.

7. The image processing apparatus according to claim 1, wherein, when dot data which causes the front nozzle line to perform discharging is corrected dot data which causes the rear nozzle line to perform discharging, or when dot data which causes the rear nozzle line to perform discharging is corrected dot data which causes the front nozzle line to perform discharging, correction is performed such that the number of corrected dots does not exceed a predetermined ratio.

8. The image processing apparatus according to claim 1, wherein, when an interval between the front nozzle line and the rear nozzle line differs in accordance with an ink color, dot data is corrected for an ink color associated with an interval longer than a predetermined distance.

9. The image processing apparatus according to claim 1, wherein, a parameter corresponding to a moving speed of a print head is determined, and dot data which causes the front nozzle line to perform discharging is corrected to dot data which causes the rear nozzle line to perform discharging when the moving speed is greater than a predetermined value, or dot data which causes the rear nozzle line to perform discharging is corrected to dot data which causes the front nozzle line to perform discharging when the moving speed is greater than the predetermined value.

10. An imaging processing method of generating, from image data, print data used for a printing apparatus that comprises a head which is movable in a primary scan direction relative to a medium and in which a plurality of nozzles adapted to discharge the same color ink to form dots are provided, the method comprising:

when performing a halftone process for generating dot data from the image data and print data generation for generating the print data based on the dot data, in either one of the halftone process or the print data generation, when generating dot data including a dot size and a dot position of a first dot and a second dot that is larger than the first dot, correcting the dot data of the first dot and the second dot in accordance with which of a front nozzle line or a rear nozzle line in the primary scan direction the first dot and the second dot correspond.

* * * * *